US006671157B1

(12) United States Patent
Meid et al.

(10) Patent No.: US 6,671,157 B1
(45) Date of Patent: Dec. 30, 2003

(54) METHOD FOR EFFECTING AN ELECTRONIC DRIVE CONTROL

(75) Inventors: Wolfgang Meid, Muelheim-Kaerlich (DE); Wilhelm Melchert, Hennef (DE); Gerd Schmitz, Troisdorf (DE)

(73) Assignee: Moeller GmbH, Bonn (DE)

( * ) Notice: Subject to any disclaimer, the term of this patent is extended or adjusted under 35 U.S.C. 154(b) by 141 days.

(21) Appl. No.: 10/048,047

(22) PCT Filed: Jul. 15, 2000

(86) PCT No.: PCT/EP00/06774

§ 371 (c)(1),
(2), (4) Date: Jan. 24, 2002

(87) PCT Pub. No.: WO01/08181

PCT Pub. Date: Feb. 1, 2001

(30) Foreign Application Priority Data

Jul. 26, 1999 (DE) ..... 199 35 044

(51) Int. Cl.[7] ..... H01H 47/00

(52) U.S. Cl. ..... 361/152; 361/195; 361/139; 361/170

(58) Field of Search ..... 361/152, 139, 361/146, 170, 153, 160, 195

(56) References Cited

U.S. PATENT DOCUMENTS

| | | | | |
|---|---|---|---|---|
| 4,769,737 A | | 9/1988 | Ogita et al. | 361/203 |
| 5,377,068 A | | 12/1994 | Kaylor et al. | 361/154 |
| 5,442,511 A | | 8/1995 | Morey et al. | 361/154 |
| 5,530,615 A | | 6/1996 | Miller et al. | 361/160 |
| 5,838,077 A | | 11/1998 | Chelcun et al. | 307/130 |
| 5,914,849 A | * | 6/1999 | Perreira | 361/187 |
| 6,249,418 B1 | * | 6/2001 | Bergstrom | 361/152 |

FOREIGN PATENT DOCUMENTS

| | | |
|---|---|---|
| DE | 3110314 | 4/1982 |
| EP | 0789378 | 8/1997 |

* cited by examiner

*Primary Examiner*—Anthony Dinkins
(74) *Attorney, Agent, or Firm*—Davidson, Davidson & Kappel, LLC

(57) ABSTRACT

The invention relates to a method for effecting an electronic drive control of a drive coil of a protection system using an electronic device which comprises a microcontroller. The aim of the invention is to increase the serviceable life of a protection system. To this end, the invention uses a randomly selected and constantly changing delay time ($t_x$) that occurs after a time ($t_2$, $t_3$) at which the supply voltage is established on the electronic device.

14 Claims, 5 Drawing Sheets

METHOD FOR EFFECTING AN ELECTRONIC DRIVE CONTROL

BACKGROUND

The present invention relates to a method for controlling a drive coil of a contactor.

An electronic drive control for a magnetic drive is known from European Patent Application EP 0 789 378 A1.

If the control voltage of a contactor is drawn from one of the three phases, synchronization effects can ensue between the closing or opening angle of the main contacts in the load circuit and the AC control voltage.

This is due to the fact that a certain voltage build-up of the supply voltage for the electronics has to take place.

If the control voltage is switched on at voltage zero, then the supply voltage does not build up immediately but only at a later point in time. Around this point in time, an unwanted synchronization takes place as a result of which one of the three switching contacts of the contactor is always subject to higher wear. This means, that one contact has a switch-on point at which the voltage level is approximately identical, independently of the instant of the control signal. Since the service life of the contactor depends on the service life of the most eroded contact, the synchronization results in shortened service life of the overall device.

SUMMARY OF THE INVENTION

An object of the present invention is to provide a method for electronic drive control of a drive coil of a contactor with which the service life of the contactor is increased.

The present invention provides a method for controlling a drive coil of a contactor having main contacts for a load current. The method includes providing an electronic drive control apparatus including a microcontroller. A randomly selected constantly varying time delay is applied in the microcontroller after a time at which a supply voltage has built up at the electronic drive control apparatus and before a time at which the supply voltage is measured.

Via the present invention, an irregular erosion of the switching contacts is prevented and, consequently, the service life of the contactor is increased.

With reference to the drawings, embodiments of the present invention will be described and illustrated in greater detail.

BRIEF DESCRIPTION OF THE DRAWINGS

The present invention will be elaborated upon below with reference to the drawings, in which.

DETAILED DESCRIPTION

Figure 1:
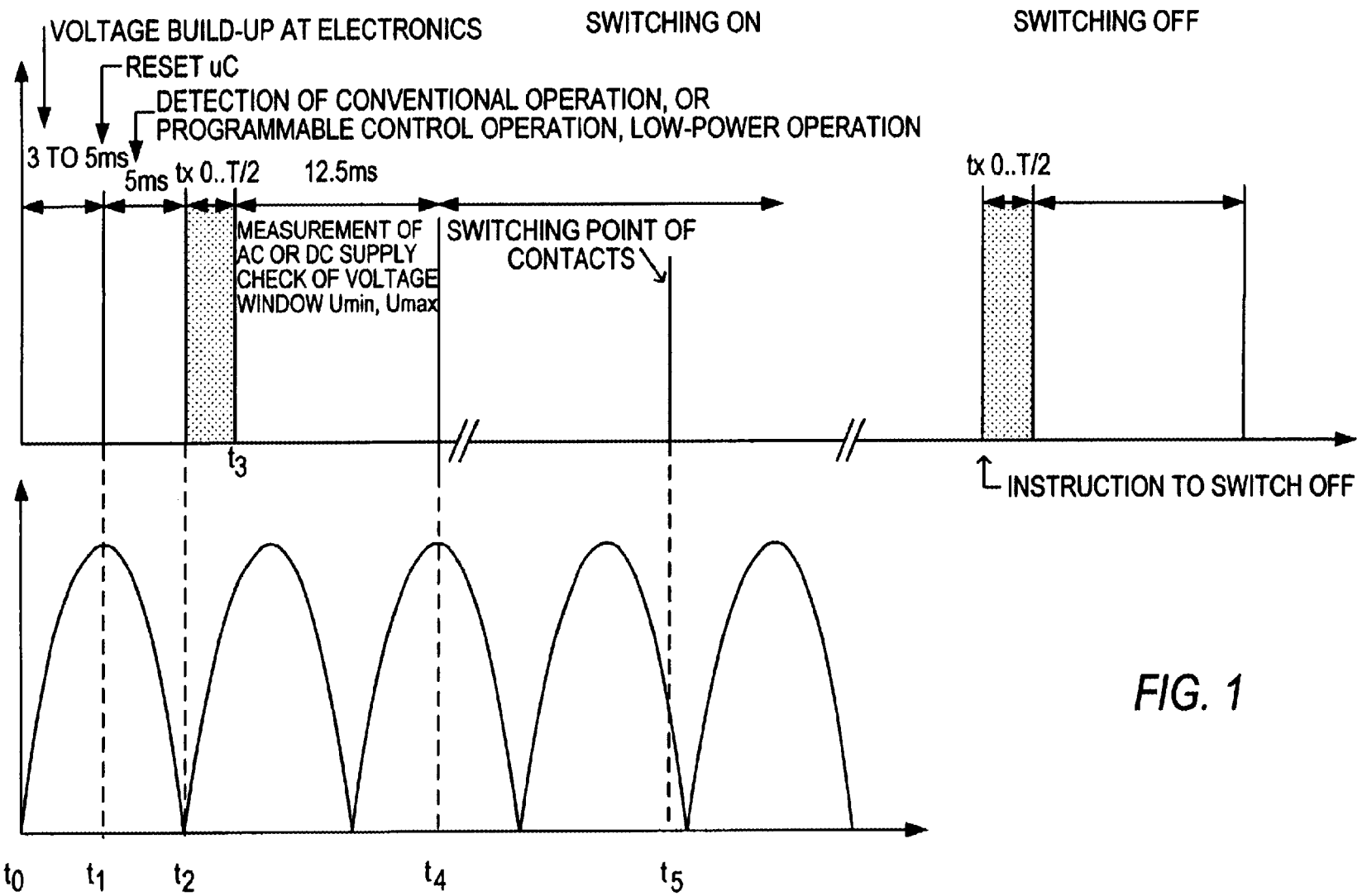
FIG. 1 shows a timing diagram in accordance with the present invention.

FIG. 1 shows a timing diagram in which the rectified supply voltage is shown in a lower graph, the supply voltage being an AC voltage.

Subsequent to switching on the supply voltage at instance $t_0$ which is lies at the voltage zero crossing, the voltage of the electronics builds up only after 3 to 5 ms. Subsequent to this voltage build-up, a reset signal occurs for a microcontroller. The program is started. After this instant $t_1$, the state is detected in which the contactor is operated. It is checked which type of control is concerned. The detection refers to the conventional operation, programmable control operation or low-power operation. This input recognition takes approximately 5 ms, the end of recognition being denoted by $t_2$. If a voltage level is present, then the conventional operation is detected.

After this point in time, to prevent synchronization effects, provision is made for a randomly determined delay time $t_x$ ranging between zero and half the period duration of the control voltage.

The supply voltage is measured only after this delay time, the point in time being denoted by $t_3$, it being possible for the supply voltage to be both a DC and an AC voltage. In this connection, it is checked which supply voltage is concerned (AC or DC). The level of the applied voltage is ascertained at the same time.

After $t_3$, it is checked, moreover, whether the supply voltage lies within a predetermined voltage window Umin, Umax, i.e., whether the determined value lies in the permissible range.

These processes take approximately 12.5 ms, it being possible for instant $t_4$ at which the contactor drive is activated, that is, the pickup process is initiated, to lie at any point of the sine curve of the supply voltage due to delay time $t_x$. The time of the pickup process is different, depending on the contactor type. Depending on the contactor type, the pickup takes place after 50 to 100 ms.

Switching point $t_5$ of the contacts is distributed at random for the other phases as well, resulting in a uniform loading of the switching contacts.

Figure 2:
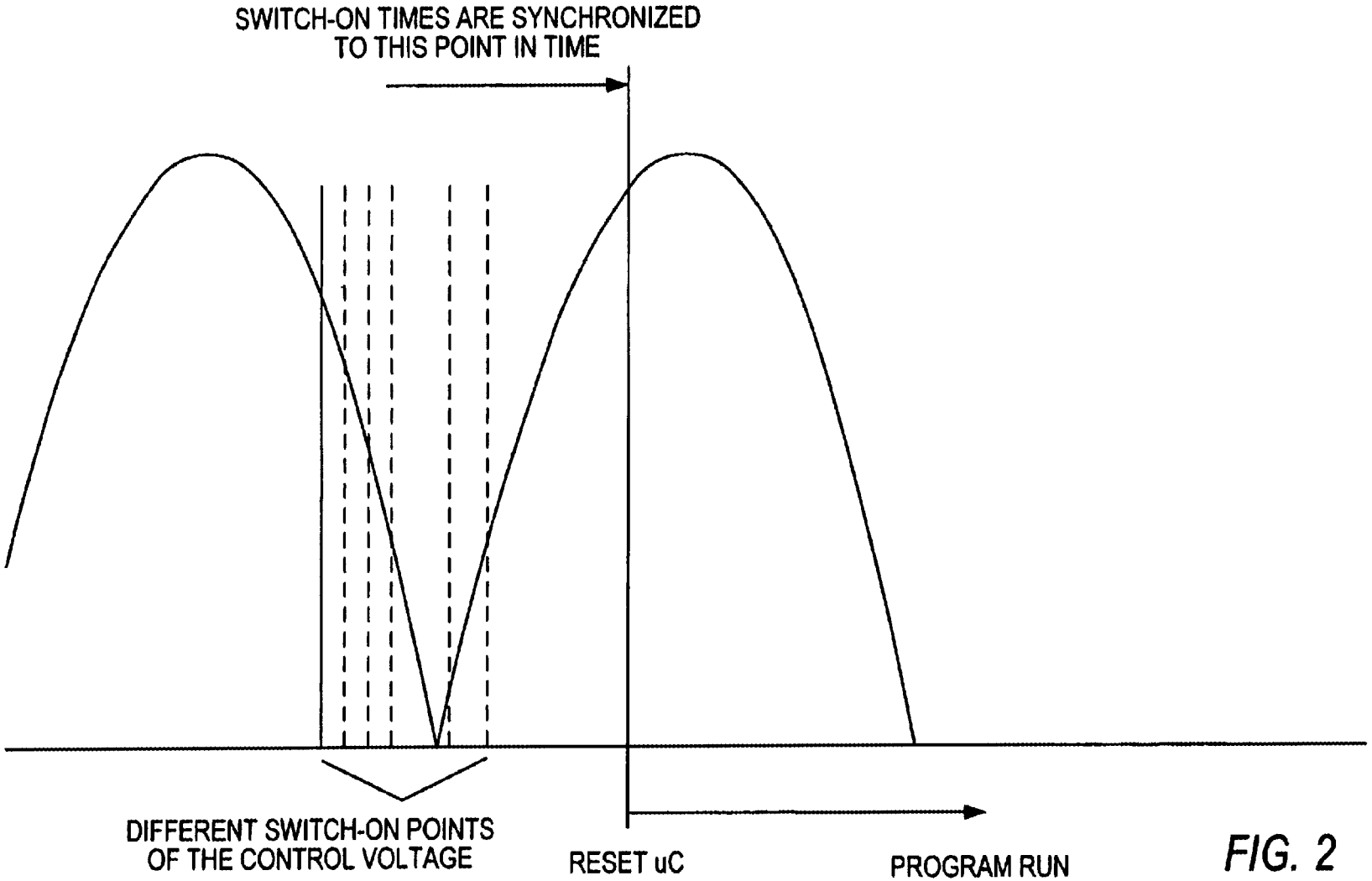
FIG. 2 depicts a timing diagram without delay time in accordance with a prior art system.

The unwanted synchronization effect will be explained in greater detail with reference to FIG. 2. The broken lines show different switch-on points with which different voltage values can be associated. Since the voltage for starting the microcontroller must first be built up, the reset signal lies always at the same point of the curve nearly independently of the switch-on time so that the switch-on times are virtually synchronized to the same reset time.

If the control voltage is switched on, for example, at the voltage zero point, then the supply voltage for the electronics does not build up immediately.

Using the explained method, unwanted synchronization effects between the closing angle or opening angle of the main contacts in the load circuit are prevented.

To implement a timing element having a variable time which is set at random, a random-number generator is required. The value delivered by the random-number generator is subsequently processed in such a manner that, via the subsequent processing of the value, a time from zero to maximally half the period duration of the control voltage ensues.

A random value is obtainable in two ways.

Figure 3:
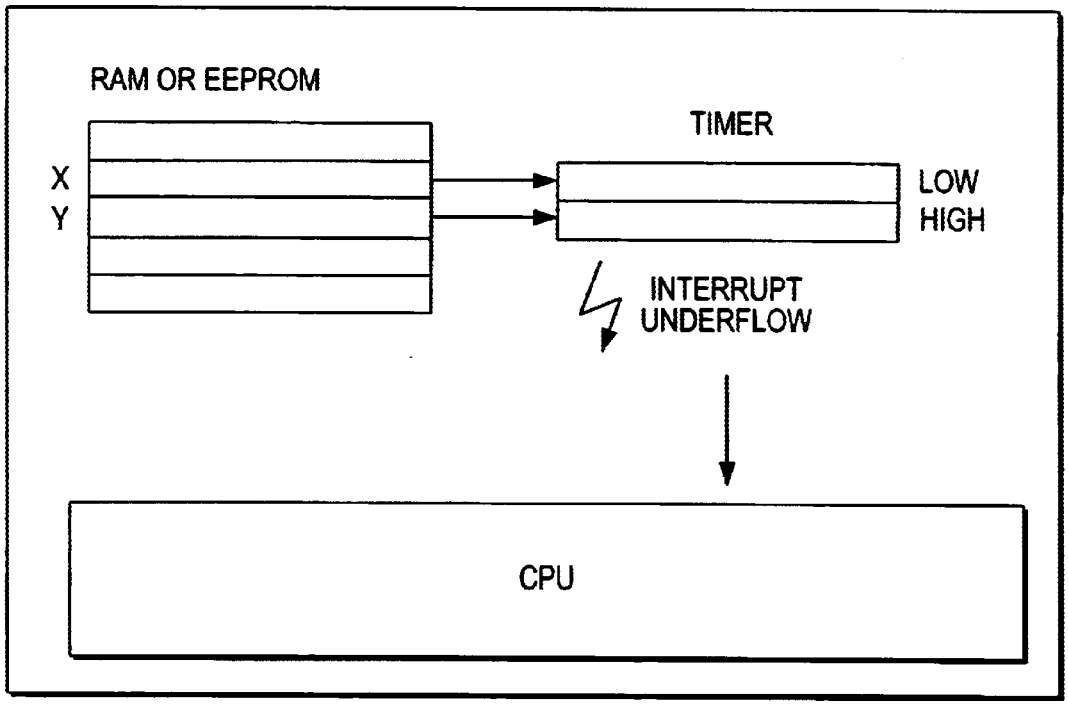
FIG. 3 shows a schematic representation of an electronic drive control system.

FIG. 3 shows a schematic representation of an electronic drive control system.

In a first embodiment, a value in a RAM storage location 11 in the microcontroller is read out, the content of this cell subsequent to switching on the voltage being undefined.

In a second embodiment, a value is obtained form a storage cell, or location, 1 of an EEPROM, the value being manipulated appropriately. The old value is utilized for determining the new value. The old value is then replaced with the new value in the EEPROM.

Figure 4:
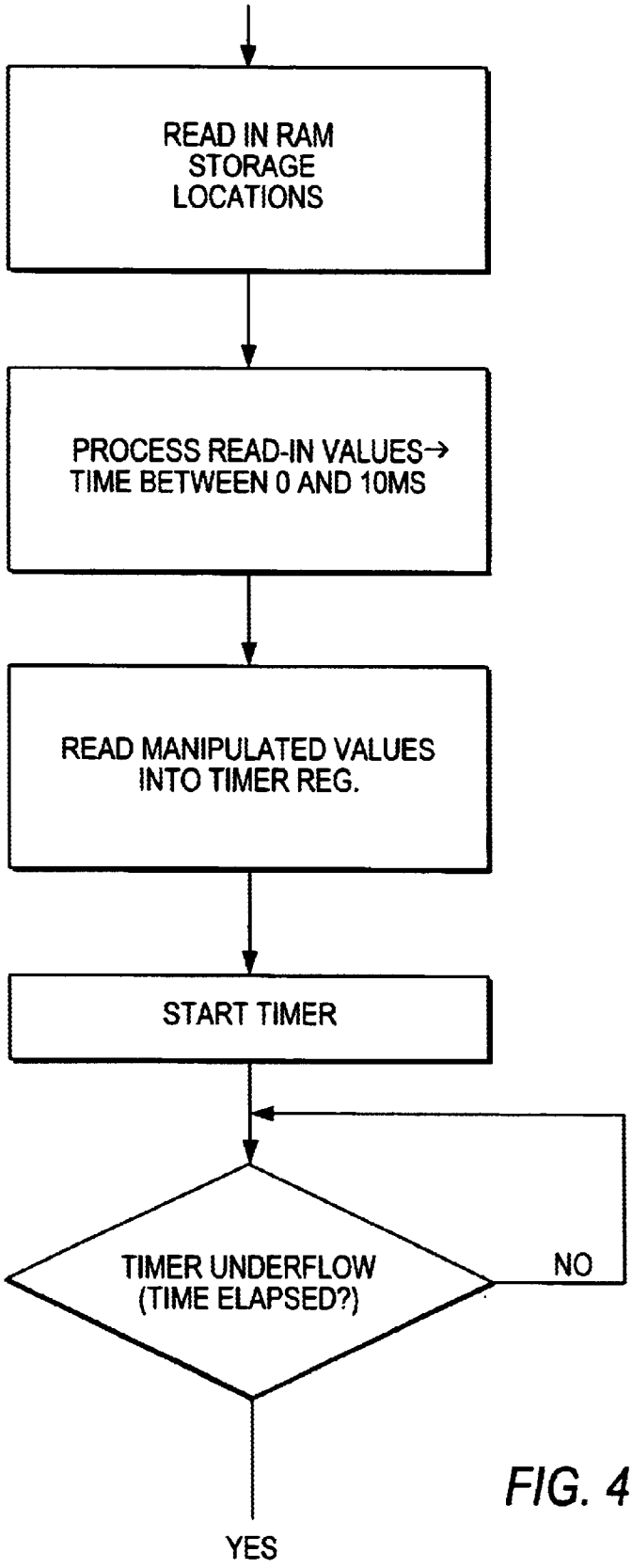
FIG. 4 depicts a flow chart of a first embodiment of a method for controlling a drive coil of a contactor.

FIG. 4 shows the appertaining flow chart for the implementation with a RAM.

In a second embodiment, a value is obtained from a storage cell, or location, 1 of an EEPROM, the value being manipulated appropriately. The old value is utilized for determining the new value. The old value is then replaced with the new value in the EEPROM.

Subsequently, the manipulated value is written into a register 2. Then, the timer is started. When the timer reaches the value zero, then a timer underflow ensues which is forwarded to the CPU, and the program is continued.

Figure 5:
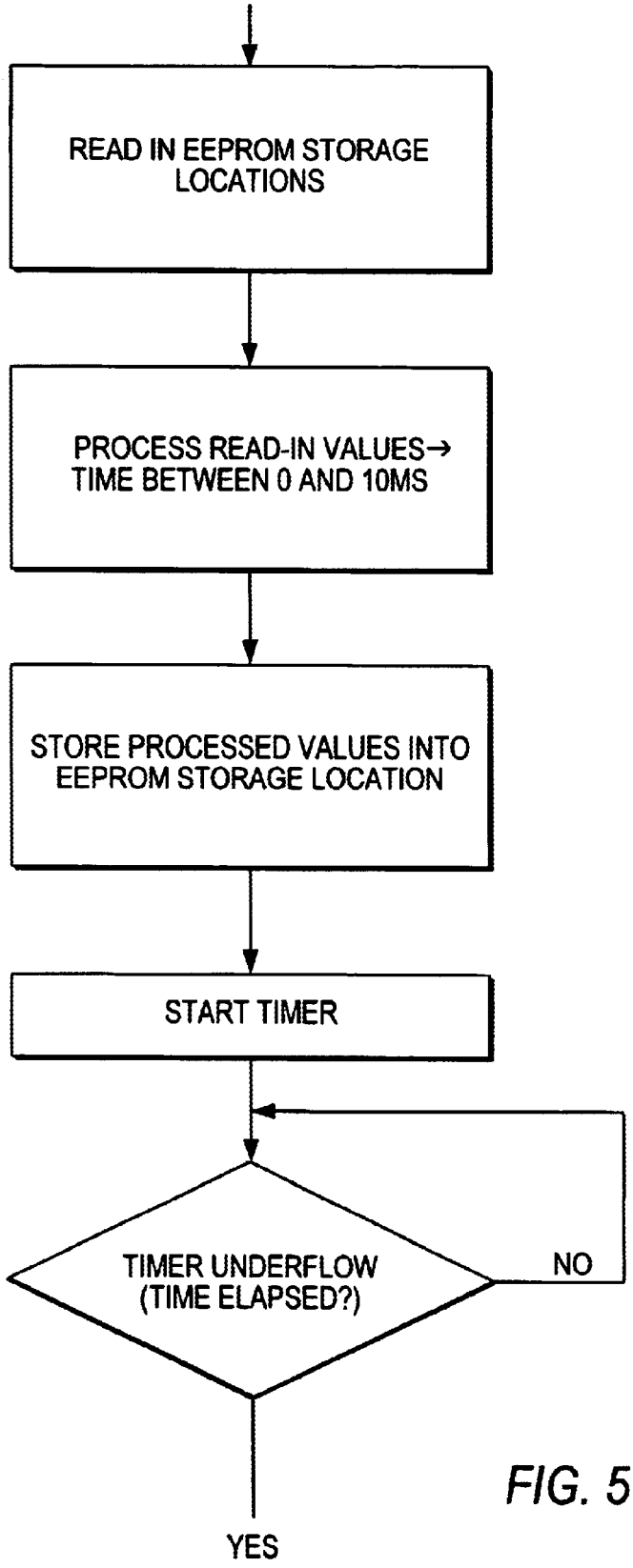
FIG. 5 shows a flow chart of a second embodiment of a method for controlling a drive coil of a contactor.

FIG. 5 shows the corresponding flow chart.

Due to this additional time loop, the closing and opening angles of the main contacts with respect to the control voltage are not synchronized.

What is claimed is:

1. A method for controlling a drive coil of a contactor having main contacts for a load current, the method comprising:

providing an electronic drive control apparatus including a microcontroller; and applying a randomly selected constantly varying time delay in the microcontroller after a time at which a supply voltage has built up at the electronic drive control apparatus and before a time at which the supply voltage is measured.

2. The method as recited in claim 1 wherein the delay time has a magnitude between zero and half a period duration of a control voltage of the electronic drive control apparatus.

3. The method as recited in claim 1 further comprising starting a detecting of a type of control in which the contactor is operated and wherein the applying the time delay is performed after a completion of the detecting the type of control.

4. The method as recited in claim 3 wherein the type of control is at least one of a conventional operation, a programmable control operation and a low-power operation.

5. The method as recited in claim 4 wherein a time difference between a start of the detecting the type of control and the completion of the detecting is approximately 5 ms.

6. The method as recited in claim 1 further comprising checking the supply voltage for at least one of AC and DC operation after the applying the delay time.

7. The method as recited in claim 1 further comprising checking, after the applying the delay time, whether the supply voltage lies within a predetermined voltage window.

8. The method as recited in claim 1 further comprising:

checking the supply voltage after the applying the delay time; and activating the drive coil approximately 10 to 15 ms after a completion of the checking so as to initiate a pickup operation.

9. The method as recited in claim 8 wherein the activating is performed 12.5 ms after the completion of the checking.

10. The method as recited in claim 1 further comprising determining the delay time using a timing element operating as a random-number generator, the random-number generator producing a value which is subsequently processed so as to yield a time from zero to at most half a period duration of a control voltage of the electronic drive control apparatus.

11. The method as recited in claim 1 further comprising reading from a RAM storage location of the microcontroller a value to be associated with the delay time, a content of the storage location being undefined subsequent to a switching on of the supply voltage.

12. The method as recited in claim 11 further comprising:

manipulating the read value; then writing the manipulated value into a register as a timer; then starting the timer so as to achieve a timer underflow when the timer reaches a zero value; then forwarding the timer underflow to a CPU; and then continuing a program.

13. The method as recited in claim 1 further comprising:

reading a value from a storage location of an EEPROM;

determining a new value from the read value; and replacing the read value with the new value in the EEPROM.

14. The method as recited in claim 1 further comprising measuring and checking the supply voltage.

* * * * *